US005542545A

United States Patent [19]

Yu

[11] Patent Number: 5,542,545

[45] Date of Patent: Aug. 6, 1996

[54] PROCESS FOR PHOSPHATE BENEFICIATION

[75] Inventor: Ying X. Yu, Lakeland, Fla.

[73] Assignee: Ying Xue Yu, Lakeland, Fla.

[21] Appl. No.: 226,601

[22] Filed: Apr. 12, 1994

[51] Int. Cl.[6] ..... B03D 1/02; B03D 1/004

[52] U.S. Cl. ..... 209/166; 252/61

[58] Field of Search ..... 209/166, 167, 209/902; 252/61

[56] References Cited

U.S. PATENT DOCUMENTS 4,200,522 4/1980 Dorrepaal .
4,309,282 1/1982 Smith .
4,790,931 12/1988 Koester .

*Primary Examiner*—Thomas M. Lithgow
*Attorney, Agent, or Firm*—Pennie & Edmonds

[57] ABSTRACT

A process is described for separation of oxidic minerals, such as phosphate. The process is a froth flotation process utilizing a novel collector, which is comprised of:

1. tall oil or any other commercial fatty acids that may contain rosin;
2. fuel oil;
3. N-substituted-N-mixed alkyoxy-propylmaleimic acid derivative;
4. fatty acid sulfonate;
5. alkyl alcohol ether sulfate;
6. alkyl alcohol sulfate;

The collector is added to the aqueous slurry of phosphate ore to be conditioned in a conventional manner. The conditioning reagents include alkaline pH modifiers, such as sodium hydroxide, sodium carbonate or ammonia. The conditioning pH value is controlled at 7.0–11.5. After conditioning, the reagentized slurry is transferred into a flotation cell and flotation is conducted in a traditional process.

11 Claims, 1 Drawing Sheet

PROCESS FOR PHOSPHATE BENEFICIATION

FIELD OF THE INVENTION

The present invention relates to a froth flotation method for the beneficiation of phosphate ore. More particularly, it relates to anionic flotation using a mixed collector comprised of naturally derived fatty acids, fuel oil and certain surfactants.

BACKGROUND OF THE INVENTION

Chemical agents, which is frequently referred to as collectors, are used in conjunction with froth flotation to aid the beneficiation or concentration of phosphate content, or $P_2O_5$ from phosphate rock. Phosphate rock is a natural rock consisting largely of calcium phosphate and used chiefly as a raw material for manufacture of phosphate fertilizers, phosphate acid and phosphorous, and therefore indirectly used for practically all commercial phosphorus chemicals. In the U.S., most deposits of phosphate ores are located in Florida and North Carolina, especially in Florida, which produces 80% of United States and one third of the world phosphate rock. The deposit in Florida contains siliceous materials, such as silica which are valueless constituents. Other valueless constituents such as calcium carbonate, some carbonaceous materials and heavy metal minerals may also be contained in the deposit. In order to meet the chemical standard of phosphoric acid production, it is generally required to concentrate the phosphate content, generally measured by the "bone phosphate of lime" commonly abbreviated to BPL, by rejecting the valueless materials from raw phosphate minerals.

Many methods have been explored and used to beneficiate or concentrate the phosphate constituent by removing the siliceous, carbonaceous and other heavy metal constituents. Flotation is a principal means by which phosphate and other ores are concentrated. Generally, flotation is a process to separate finely ground valuable minerals from their associated gangue or waste, or to separate one valuable component from another. In froth flotation, frothing occurs by introducing air into a slurry of finely divided ore and water containing a frothing agent. Minerals that have a special affinity to air bubbles rise to the surface in the froth and thus are separated from the slurry. The particles to be separated by froth flotation must be of a size that can be readily levitated by the air bubbles. Generally, the size is below 16 mesh (−16 mesh or −991μ). In froth flotation, the raw minerals are classified into various fractions according to the size of the particle. In Florida phosphate industry, the raw minerals, which generally is called matrix, is classified into +16 mesh fraction, −16 to +150 mesh (+105μ) fraction, and −150 mesh fraction. The +16 mesh fraction, generally called pebble, is rich in BPL content and thus used directly for consumption at chemical plant. The −16 mesh to +150 mesh fraction is fed to beneficiation plant for flotation. The −150 mesh fraction, which primarily contains dry slime, is usually discarded as a waste prior to flotation.

Froth flotation agents used in conjunction with flotation must be capable of selectively coating the desired mineral material in spite of the presence of many other mineral species.

In a typical beneficiation process, the matrix is first sized to remove the pebble. Subsequently, the slime is removed in a hydro-cyclone from what constitutes flotation feed. The phosphate values are then extracted from the flotation sized slurry through a two-phase froth flotation process, frequently referred to as "Crago process" or "double flotation". This process consists of the following procedures: 1) conditioning the flotation feed materials with fatty acid and fuel oil, 2) flotation of the phosphate minerals in flotation cells, 3) deoiling with sulfuric acid to remove the reagents from the surface of the floated fraction, which is typically known as the rougher concentrate containing about 10% to 30% silica, 4) the rough concentrate go through another flotation with an cafionic reagent called amine being added and this time the silica is floated. The sink portion constitutes the final product called "the phosphate concentrate". The refloating, known as cleaner or reverse flotation, is needed to remove the remaining silica contained in the rougher concentrate and thus improve the grade of final concentrate phosphate.

A variety of promoters or additives for the anionic flotation of phosphate rock with fatty acids are know in the prior art. A promoter or an additive is a substance, which, when added to the flotation reagent, will significantly increase the recovery and/or grade of the phosphate material, thereby greatly increasing the efficiency and economics of the flotation process. Generally speaking, addition of surfactants or some other chemicals to the flotation reagents leads to a trade off between these two parameters: usually, an increase in recovery leads to a corresponding drop in selectivity or grade, and vice versa. In today's phosphate industry, recovery is most important and this invention has found a mixture of promoters or additives to increase both recovery and grade or increase recovery without decreasing the desired grade.

There are many United States patents which describe a combination of fatty acid and other surfactants for improved recovery or/and grade of phosphate or other non-sulfide ores by froth flotation. However, the results of these prior arts are not only limited to bench scale test, but also achieved recovery improvement without improving flotation economics.

SUMMARY OF THE INVENTION

We have found that certain surfactants serve as a promoter to amplify the collecting efficiency of the collectors and improve the property of the froth in the froth flotation process. The collector is generally composed of following surfactants:

1. a fatty acid sulfonate;
2. a N-substituted-N-mixed alkyoxy propylmaleimic acid derivative;
3. an alkyl alcohol ether sulfate;
4. an alkyl alcohol sulfate;

It has now been found through my study that certain surfactant such as fatty acid sulfonate, alkyl alcohol ether sulfate, N-substituted-N-mixed alkyloxy propylmaleimic acid derivative and alkyl alcohol sulfate combined with fatty acid can increase both recovery and selectivity of the existing flotation process. That has been proved in both bench tests and industrial tests. Therefore, the present invention provides a new anionic flotation agent for the beneficiation of phosphate ores comprising the following composition:

1. about 30% to about 70% by weight of fatty acids (tall oil fatty acid or any other resources);
2. about 0.4% to about 2.4% of fatty acid sulfonate with the general molecular formula $$R-\underset{\underset{SO_3M}{|}}{CH}-(CH_2)_n-COOM$$

Wherein R is alkyl with 8 carbons, N is from 6–8, M is $H^+$, $Na^+$, $K^+$ or $NH_4^+$.

3. about 2% to about 15% alkyl alcohol ether sulfate with the general molecular formula $$R-(OCH_2CH_2)_n-OSO_3M$$

Wherein R is alkyl with from 10 to 22 carbons, n is from 1 to 8 and M is $H^+$, $Na^+$, $K^+$ $NH_4^+$.

4. about 0.3% to about 3.6% of alkyl alcohol sulfate with the general molecular formula $$R-OSO_3M$$

Wherein R is alkyl with 6 to 18 carbons and M is $H^+$, $Na^+$, $K^+$ $NH_4^+$.

5. about 0% to about 7.0% of N-substituted-N-mixed alkyloxy-propylmaleimic acid derivative which is a product provided by Westvaco corporation by the trade name of WMX-6622-22c.
6. about 30% to about 60% fuel oil, which may either be added in the agent formula or added separately in the conditioning slurry.

Further, the present invention provides a widened range of conditioning pH value in the froth flotation of a phosphate ore with a particle size ranging from 16 mesh to 150 mesh containing substantial particles of apatite and silica mineral impurity.

The phosphate ore is conditioned at an alkaline pH in an aqueous conditioning slurry with the novel anionic reagent referenced above in an amount of 0.6 to 2.0 lb. per ton flotation feed. The conditioning pH value is changed from conventional 8.0–11.5 to 7.0–11.5. After conditioning, the reagentized slurry of phosphate ore is sent to the froth flotation circuit, wherein the apatite from the phosphate ore is recovered in the froth fraction. The flotation pH value is changed from conventional about 8.0 to a range about 6.0 to about 9.0. The rest of the process remains the same as the existing flotation process.

BRIEF DESCRIPTION OF THE DRAWING

FIG. 1 is a flow sheet of the Phosphate Flotation Plant which the process was tested on.

DETAILED DESCRIPTION OF THE INVENTION

Figure 1:
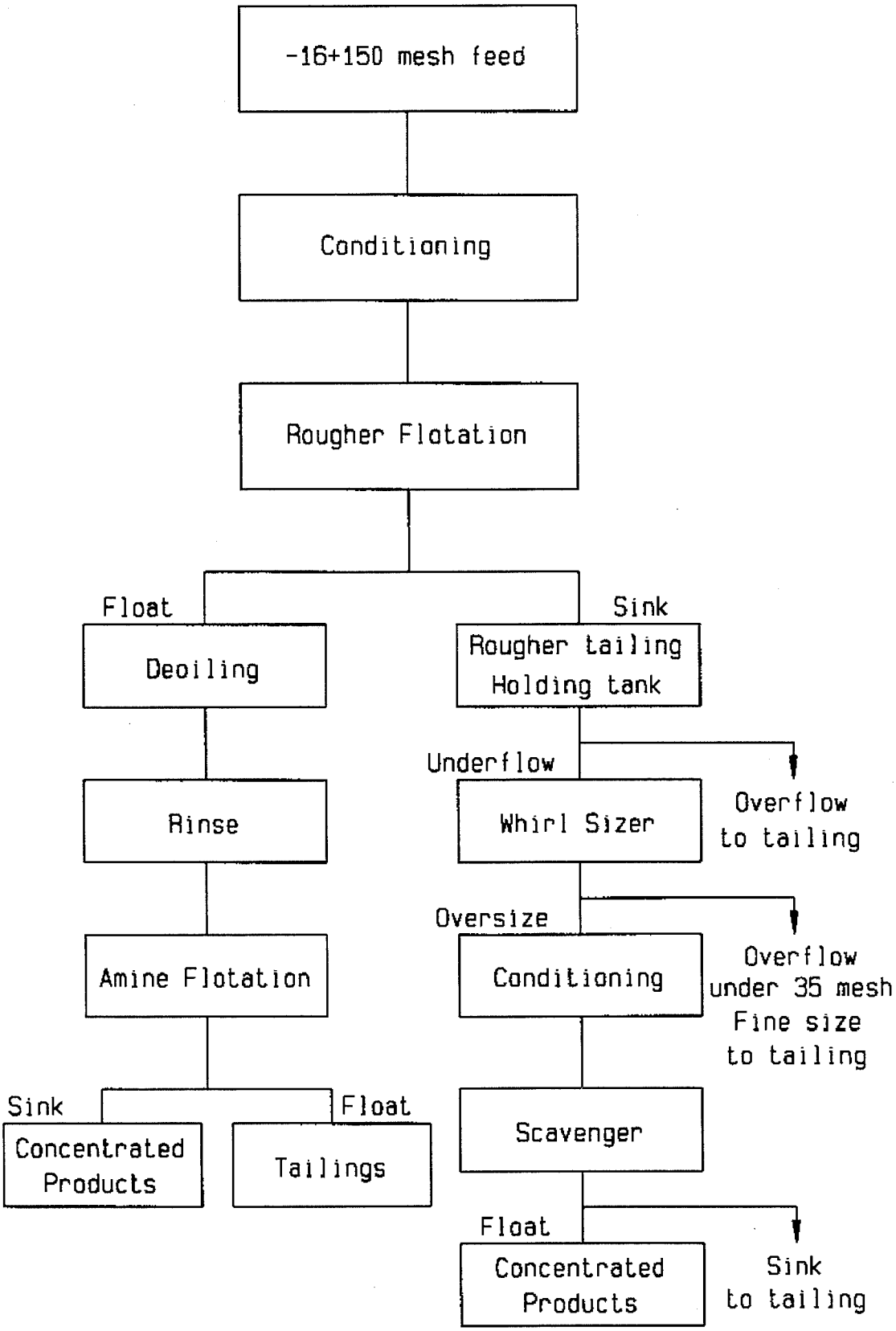

In this invention, a novel anionic flotation reagent combination is employed in the typical phosphate flotation process as generally described in the above.

In froth flotation using the agent of the present invention, the raw phosphate ore, or so-called matrix, is divided into desired particle size group through vibrations screening. A particle size between 16 mesh and 150 mesh is usually employed as a flotation feed. While larger particle size fraction containing high BPL are conveyed to chemical plant for direct consumption, the particles smaller than 150 mesh are generally removed in a process called "desliming". As a result of economical inefficiency of beneficiation of those particles of smaller size under the current technology, they are discarded as waste, though they may contain significant apatite values. The particle sized from −16 mesh to +150 mesh is used as flotation feed. Generally the size fraction of −16 mesh to +150 mesh is further divided into two subgroup: −16 to +35 mesh portion, or generally referred to as coarse feed fraction, and −35 mesh to +150 mesh portion, or called fine feed fraction. The two fractions are floated in separate flotation sink. But in some flotation plants, no sub-division is made to −16 mesh to +150 mesh group. In this case, it is generally called a unsized feed and this happens to be the case in the industrial scale tests.

The flotation feed generally containing about 10% −30% BPL is a slurry containing 60%–75% solid. The pH value of the slurry then is modified to the range of about 7 to about 11.5 and conditioned with an effective amount of the novel agents combination consisting of such chemicals as listed above. The conventional pH modifiers (sodium hydroxide) are employed in the novel process. The slurry of phosphate ores are conditioned (reagentized) at a pH value in the range of about 7.0 to about 11.5, preferably about 8.5 to about 9.5.

After the phosphate ore in the slurry is reagentized, it is transferred to froth flotation using the conventional method. The flotation pH is either kept under a pH value as it is or adjusted to the range of 6.0 to 9.0, preferably 7.5 to 8.5 with convention pH modifiers or the like. The phosphate (called rougher concentrate) are recovered in the froths and silica as a gangue is left behind (called rougher tailings). The froths containing the rougher concentrate is scrubbed out and transferred to the reverse flotation process, while the rougher tailings (still containing a certain amount of phosphate ore) are sent to a scavenger flotation circuit. In the scavenger, the rougher tailing is subject to the whirl sizer for particle size classification. The overflow or undersized fraction is discarded as a final tailings. The oversize fraction containing about 75–80% solids is subject to reconditioning in a drum conditioner and an effective amount of the novel agent is added and reagentized at a pH value of about 7.0 to 12, preferably 8.0–10.0. After being reagentized, the slurry is transferred to column to float out the phosphate mineral remaining in the rougher tailings, wherein a conventional frother may be added in this column flotation. The floated fraction constitutes final concentrate product and the sink fraction final tailings.

The attached tables indicate the grade of, respectively, flotation feed, scavenger feed, final concentrate, scavenger tailing, and final tailing, sample at which are taken with an automatic sampler for 20 minutes time intervals and a integrated sample being analyzed for every four running hours or eight hours.

The recovery is calculated by the following formula:

$$\text{Recovery} = \frac{C(F-T)}{F(C-T)} \times 100\%$$

Wherein: C is BPL% of final concentrate

F is BPL% of flotation feed

T is BPL% of final tailing

With the exception of the novel reagents and new pH value parameters during conditioning, the plant test has been carried out exactly in the same way with the conventional or Crago process. The existing process of the plant was described in this art before (Crago). It is a two-step flotation with the unsized flotation feed, including a rougher flotation circuit, a scavenger and a cleaner flotation (amine or reverse flotation). Scavenger is a circuit in which the coarser particle fraction (+35 mesh) is separated out from rougher tailings and the phosphate mineral remaining in this fraction is floated out again with same anionic agent which is used in the rougher flotation circuit. In the tests, the novel anionic agent replaced the existing anionic reagent which is a Westvaco agent (U.S. Pat. No. 4,330,398, May 18, 1982). This agent is a fatty acid soap combined with sulfate, trade name: 27AR. The pH value of the agent is ranged from 11.5 to 12.5, and therefore it is unnecessary to adjust the pH value during conditioning of the slurry. The comparison of the results between the present novel process and the conventional is based on the statistic data in the history of the plant. For example, measure of recovery increase is based on a metallurgical—objective recovery, which is calculated in accordance with a formula worked out by co-relating a group of actual historical recovery figures of the plant under the circumstances of various feed grades, since flotation recovery level is related to the grade of flotation feed.

$R—OSO_3M$

Wherein R is from 12 carbons and M is $Na^+$.

1.2–1.5 LB per ton flotation feed of the agent usage was controlled with automatic pumps. Conditioning was conducted under a slurry pH value of 8.5–8,7 which was adjusted with 15% NaOH solution. After conditioning the reagentized slurry was transferred into the Denver flotation cells wherein the pH of the flotation slurry was not further modified. The industrial test with the novel reagents was carried out for six days and a total of 113 hours. The samples from different sampling points were sampled with an automatic samplers which were set up for 20 minutes in time interval and an integrated sample for every 4 hours. The result are presented in Table I.

TABLE I

| Feed BPL % | Rougher Conc. BPL % | Final Conc. BPL % | Final Tailing BPL % | Test Rec. (%) | Met-Obj. Rec. % | Recovery Increased % |
|---|---|---|---|---|---|---|
| 14.8 | 57.38 | 63.77 | 2.95 | 83.97 | 74.41 | 9.56 |
| 15.7 | 62.33 | 70.25 | 2.93 | 84.91 | 75.45 | 9.47 |
| 13.7 | 62.00 | 71.59 | 3.47 | 78.40 | 73.04 | 5.36 |
| 14.6 | 65.58 | 69.92 | 2.51 | 85.89 | 74.07 | 11.73 |
| 12.3 | 64.43 | 71.26 | 2.14 | 85.13 | 71.27 | 13.86 |
| 13.3 | 60.48 | 69.78 | 1.73 | 89.21 | 72.60 | 16.61 |
| 15.6 | 63.43 | 68.85 | 2.19 | 88.75 | 75.26 | 13.49 |
| 16.0 | 63.86 | 70.19 | 2.91 | 85.40 | 75.79 | 9.61 |
| 14.3 | 65.00 | 69.56 | 2.49 | 86.18 | 74.32 | 11.86 |
| 16.9 | 65.17 | 72.00 | 2.47 | 88.43 | 76.71 | 11.71 |
| 14.1 | 64.08 | 68.20 | 2.27 | 86.84 | 73.62 | 13.22 |
| 14.6 | 60.47 | 70.06 | 2.82 | 84.12 | 74.21 | 9.91 |
| 15.6 | 65.93 | 73.12 | 3.32 | 82.40 | 75.26 | 7.14 |
| 15.2 | 58.45 | 73.03 | 3.54 | 80.64 | 74.87 | 5.77 |
| 14.4 | 59.11 | 68.83 | 3.34 | 80.65 | 73.88 | 6.77 |
| 14.0 | 62.14 | 72.00 | 3.43 | 79.24 | 73.43 | 5.81 |
| 14.1 | 61.13 | 68.06 | 3.45 | 79.53 | 73.55 | 5.98 |
| 14.3 | 60.22 | 70.41 | 2.60 | 84.89 | 73.75 | 11.14 |
| 13.0 | 60.03 | 65.88 | 3.34 | 78.32 | 72.24 | 6.08 |
| 15.6 | 63.20 | 67.98 | 3.58 | 81.40 | 75.35 | 6.05 |
| 14.6 | 62.22 | 69.74 | 2.87 | 83.71 | 74.16 | 9.56 |

EXAMPLE 1

The industrial scale test, with the invented agent, were conducted in the U.S. Agri-Chemicals. The following formula of the notation plant of invented agent was tested.

46% of tall oil fatty acid

46% of Fuel oil

3% of Alkyl Alcohol ether sulfate wherein a general formula of the surfactants is following $R—(OCH_2CH_2)n—OSO_3M$ R is a alkyl with 12–14 carbons n is 2–4, and M is $Na^+$ 2.0% of N-Substituted-N-Mixed Alkyoxy-Propylmaleimic Acid Derivative 0.8% of tall oil fatty acid sulfonate wherein a general formula is the following:

$$R—\underset{\underset{SO_3M}{|}}{CH}—(CH_2)_n—COOM$$

Wherein R is alkyl with 8 carbons, n is 6–8, M is $Na^+$.

0.4% of Alkyl Alcohol sulfate of the following formula:

The result indicates that industrial scale tests with the novel reagent demonstrated a very high flotation efficiency. Comparing with the historical metallurgical recovery (calculated according to a fixed formula), the recovery of the tests is approximately 10% higher. Meanwhile, the grade of the rougher concentrate was increased about 8% of BPL% as well. In addition, the reagent cost is not higher than that of the conventional reagent. It is therefore concluded that a significant flotation economics is achieved.

EXAMPLE 2

Industrial test in this case used the same flotation process and similar flotation feed but the grade of the feed is higher than one in example I. Another difference is that the test with novel agent of the formula was changed. The formula of the testing novel agent was without N-Substituted-N-Mixed Alkyloxy-propylmaleimic acid derivative and the percentage of fatty acid sulfonate was changed from 0.8% to 2.4%. All other comparisons are the same as example 1. The results are presented in Table II.

TABLE II

| | Feed BPL % | Final Conc. BPL % | Final Tailing BPL % | Test Rec. (%) | Met-Obj. Rec. % | Difference of Rec. % |
|---|---|---|---|---|---|---|
| | 15.31 | 70.17 | 3.34 | 82.09 | 74.98 | +7.11 |
| | 22.76 | 68.32 | 3.00 | 90.81 | 82.14 | +8.67 |
| | 22.14 | 71.51 | 3.00 | 70.24 | 81.62 | +8.62 |
| | 18.70 | 63.87 | 3.66 | 85.32 | 78.51 | +6.84 |
| | 22.60 | 66.58 | 3.74 | 88.42 | 82.01 | +6.41 |
| | 23.10 | 69.57 | 7.63 | 75.22 | 82.42 | −7.20 |
| | 22.50 | 70.01 | 2.85 | 91.04 | 81.93 | +9.11 |
| | 22.39 | 69.88 | 4.61 | 85.02 | 81.83 | +3.19 |
| Avg. | 21.19 | 68.74 | 3.98 | 86.02 | 80.68 | +5.34 |

*The "+" means test recovery increased. Otherwise decreased.

The results in the Table II indicates that the recovery of the phosphate with changed formula of the novel reagent is improved by 5% compared to the metallurgical history of the plant. It also indicates that the formula of the novel reagent can be changed or modified in a certain range if it is necessary. In addition, the novel reagent formula can be adjusted to cater to the needs of various flotation feed, regardless of its mineral characteristics.

EXAMPLE 3

An industrial test was conducted in the same plant and used similar phosphate ore, but used an anionic reagent which is just fatty acid combined with fuel oil without any surfactants. The fatty acids are tall oil which are the same fatty acid that were used in the novel reagent formula. The ratio of the fatty acid and fuel oil are 50 to 50. The conditioning was conducted at pH about 9.0. The other conditions are the same as example I and II. The test results are presented in Table III.

TABLE III

| Feed BPL % | Rougher Conc. BPL % | Final conc. BPL % | Final Tailing BPL % | Test Rec. (%) | Met-Obj. Rec. % | Difference of Rec. % |
|---|---|---|---|---|---|---|
| 20.93 | 43.26 | 67.24 | 7.78 | 71.05 | 80.57 | −9.52 |
| 22.16 | 42.56 | 52.88 | 9.09 | 71.22 | 81.64 | −10.42 |
| 21.15 | 37.80 | 64.51 | 6.62 | 76.56 | 80.77 | −4.21 |
| 22.07 | 39.11 | 61.29 | 5.66 | 81.92 | 81.56 | +0.36 |
| 21.81 | 46.50 | 69.62 | 7.80 | 72.34 | 81.34 | −9.00 |
| 21.94 | 35.53 | 68.17 | 9.08 | 67.62 | 81.45 | −13.83 |
| 29.15 | — | 67.63 | 9.24 | 79.11 | 86.96 | −7.85 |
| 18.16 | 34.76 | 51.24 | 8.74 | 63.97 | 78.43 | −14.46 |
| 22.23 | 39.93 | 62.82 | 8.00 | 72.97 | 81.59 | −8.62 |

*The "+" means test recovery increased. Otherwise decreased.

The data in Table III indicates that by using only fatty acid and fuel oil as a anionic collector without adding any surfactants, the recovery of phosphate was not improved at all or became even worse, compared to the plant historical recovery (the metallurgical objective recovery). On the other hand, the BPL% in the rougher concentrate is only about 40%, or about 20% lower than that using the novel agent. The above results indicate that surfactants in the novel reagent formula play a critical role.

I claim:

1. A process for the beneficiation of phosphate ore which comprises slurrying the ore in an aqueous medium, classifying the slurried ore to provide particles of flotation size, conditioning the slurry at a pH of about 7 to about 11.5 with an effective amount of a mixed anionic collector comprising a) fatty acids having C9 to C22;

b) anionic surfactants comprising a fatty acid sulfonate, an alkyl alcohol ether sulfate, and an alkyl alcohol sulfate and optionally a n-substituted-n-mixed alkyoxy propylmaleimic acid derivative;

c) fuel oil; and floating the phosphate values in the froth fraction by froth flotation.

2. The process according to claim 1 wherein the mixed anionic collector comprises about 30% to about 70% by weight of fatty acids; about 0.4% to about 2.4% of a fatty acid sulfonate; about 2% to about 15% of an alkyl alcohol ether sulfate; about 0.3% to about 3.6% of an alkyl alcohol sulfate; about 0% to about 7% of n-substituted-n-mixed alkyloxy-propylmaleimic acid derivative; and about 30% to about 60% fuel oil.

3. The process according to claim 2 wherein the fatty acids are tall oil fatty acids.

4. The process according to claim 2 wherein the fatty acid sulfonate has the formula $$R-\underset{\underset{SO_3M}{|}}{CH}-(CH_2)-COOM$$

wherein R is alkyl having 8 carbons, n is 6 to 8

M is hydrogen, sodium, potassium or ammonium.

5. The process according to claim 2 wherein the alkyl alcohol ether sulfate has the formula $$R-(OCH_2CH_2)_n-SO_3M$$

wherein R is alkyl having 10 to 22 carbons, n is 1 to 8

M is hydrogen, sodium, potassium or ammonium.

6. The process according to claim 2 wherein the alkyl alcohol sulfate has the formula $$R—OSO_3M$$

wherein R is alkyl having 6 to 18 carbons, M is hydrogen, sodium, potassium or ammonium.

7. The process according to claim 1 wherein the froth flotation is conducted at a pH about 6.0 to about 9.0.

8. The process according to claim 7 wherein the froth flotation is conducted at a pH about 7.5 to about 8.5.

9. The process according to claim 1 wherein the slurry is conditioned at a pH of about 8.5 to about 9.5.

10. The process according to claim 1 wherein the phosphate ore is slurried with water at a concentration from about 60% to about 75% by weight of solids content.

11. The process according to claim 1 wherein the phosphate ore slurry is classified into particles of flotation size from about −16 mesh to about +150 mesh.

* * * * *